US009570797B2

(12) United States Patent
Wang

(10) Patent No.: US 9,570,797 B2
(45) Date of Patent: Feb. 14, 2017

(54) THIN FLAT PANEL STYLE DIGITAL TELEVISION ANTENNA

(71) Applicant: TRANS ELECTRIC CO., LTD., Changhua Hsien (TW)

(72) Inventor: Cheng-Si Wang, Changhua Hsien (TW)

(73) Assignee: Trans Electric Co., Ltd., Changhua Hsien (TW)

( * ) Notice: Subject to any disclaimer, the term of this patent is extended or adjusted under 35 U.S.C. 154(b) by 163 days.

(21) Appl. No.: 14/551,722

(22) Filed: Nov. 24, 2014

(65) Prior Publication Data

US 2016/0149288 A1 May 26, 2016

(51) Int. Cl.

*H01Q 1/50* (2006.01)
*H01Q 1/38* (2006.01)
*H01Q 1/00* (2006.01)

(52) U.S. Cl.

CPC ..... *H01Q 1/38* (2013.01); *H01Q 1/007* (2013.01)

(58) Field of Classification Search

CPC ..... H01Q 1/24; H01Q 1/38; H01Q 1/50
USPC ..... 343/906, 702, 700 MS
See application file for complete search history.

(56) References Cited

U.S. PATENT DOCUMENTS

| | | | | |
|---|---|---|---|---|
| 7,365,685 | B2 * | 4/2008 | Takeuchi | H01Q 1/1271 343/700 MS |
| 7,423,600 | B2 * | 9/2008 | Ikeda | H01Q 1/1271 343/700 MS |
| 8,816,927 | B2 * | 8/2014 | Nakano | H01Q 1/2266 343/702 |
| 2006/0038723 | A1 * | 2/2006 | Watanabe | H01Q 9/40 343/700 MS |
| 2006/0109178 | A1 * | 5/2006 | Takeuchi | H01Q 1/1271 343/700 MS |
| 2009/0073059 | A1 * | 3/2009 | Ikegaya | H01Q 9/42 343/702 |

* cited by examiner

*Primary Examiner* — Huedung Mancuso
(74) *Attorney, Agent, or Firm* — Rosenberg, Klein & Lee

(57) ABSTRACT

A thin flat panel style digital television antenna has a radiation layer, a front insulation layer, a rear insulation layer and a connection cable. The radiation layer has a triangular hollow area and an opening formed in one edge thereof to communicate with one angle of the hollow area. The front insulation layer and the rear insulation layer are respectively overlapped on a front surface and a rear surface of the radiation layer to protect and electrically insulate the radiation layer. The radiation layer further has multiple connection holes adjacent to the opening thereof for multiple connection terminals of the connection cable to be respectively connected thereto. Given the foregoing structure, the digital television antenna has a wide frequency band, is thin and lightweight, is cost-effective in production, and is good for mounting and storage.

6 Claims, 6 Drawing Sheets

THIN FLAT PANEL STYLE DIGITAL TELEVISION ANTENNA

BACKGROUND OF THE INVENTION

1. Field of the Invention

The present invention relates to a digital television (TV) antenna and, more particularly, to a thin flat panel style digital TV antenna being thin, lightweight and compact and serving to receive digital TV signals over the air.

2. Description of the Related Art

Televisions have almost become an essential electric appliance in every household. For analog televisions back in the early days, the degree of clarity with which a televised image is displayed highly depends on the intensity of television signals carried by frequency modulation (FM) or amplitude modulation (AM) radio waves. VHF (Very High Frequency) band and UHF (Ultra High Frequency) band are major frequency bands compatible with typical analog TVs.

Due to the use of cathode ray tube (CRT), it is hard for traditional analog TVs to take picture quality into account without compromising the design concerns of being compact and lightweight. To break through the bottleneck, digital TVs based on the technologies of liquid crystal display (LCD), plasma display (PD), organic light-emitting diode (OLED) and the like gradually replace the conventional analog TVs. Most digital TVs are compatible with digital TV signals over the UHF band. As each TV antenna is designed according to the frequency band of the received TV signals thereof, technically, antennae of analog TVs can be used to receive UHF TV signals. However, attenuated TV signals inevitably lead to blurred TV images. TV signals are easily attenuated due to blockage of buildings and atmospheric rain and clouds, and are thus prone to electromagnetic interference. Therefore, regular analog TVs are normally equipped with large-size outdoor antennae to mitigate the signal attenuation. With reference to FIG. 6, a conventional analog TV antenna has two extendable streamline antennae 61 and two dish antennae 62 for receiving VHF and UHF TV signals. However, the two streamline antennae 61 and the two dish antennae 62 require larger space for mounting and storage and are operationally inflexible. Additionally, the conventional analog TV antenna is structurally complicated and has many parts, rendering inconvenience to users in mounting, cleaning and maintaining the antenna and cost-ineffectiveness in production. Accordingly, improvement should be made for the conventional analog TV antenna to be compatible for use with digital TVs.

SUMMARY OF THE INVENTION

An objective of the present invention is to provide a thin flat panel style digital television antenna with a low-cost, lightweight and compact structure, facilitating the mounting, cleanup and maintenance thereof and increasing mounting, operating and storage flexibility thereof.

To achieve the foregoing objective, the thin flat panel style digital television antenna has a radiation layer, a front insulation layer, a rear insulation layer and a connection cable.

The radiation layer is sheet-like and has a front surface, a rear surface, multiple edges, a hollow area, an opening and multiple connection holes.

The front surface and the rear surface are opposite to each other.

The hollow area is formed through the radiation layer and is triangular.

The opening is formed in one of the edges of the radiation layer adjacent to one angle of the hollow area to communicate with the angle.

The multiple connection holes are formed through the radiation layer and are adjacent to the opening.

The front insulation layer is mounted on and overlaps the front surface of the radiation layer.

The rear insulation layer is mounted on and overlaps the rear surface of the radiation layer.

The connection cable is connected with the radiation layer and has multiple connection terminals in connection with the respective connection holes of the radiation layer.

The thin flat panel style digital television antenna employs the radiation layer to achieve digital TV signal transmission, and has the advantages of being thin, flat and lightweight in favor of mounting, cleaning, repairing and storing the digital television antenna. Assembling the connection holes and the connection terminals to achieve electrical connection also rules out complicated and repetitious processes in conventional soldering to further ensure simplicity and cost-effectiveness of the present invention in production.

Other objectives, advantages and novel features of the invention will become more apparent from the following detailed description when taken in conjunction with the accompanying drawings.

DETAILED DESCRIPTION OF THE INVENTION

Figure 1:
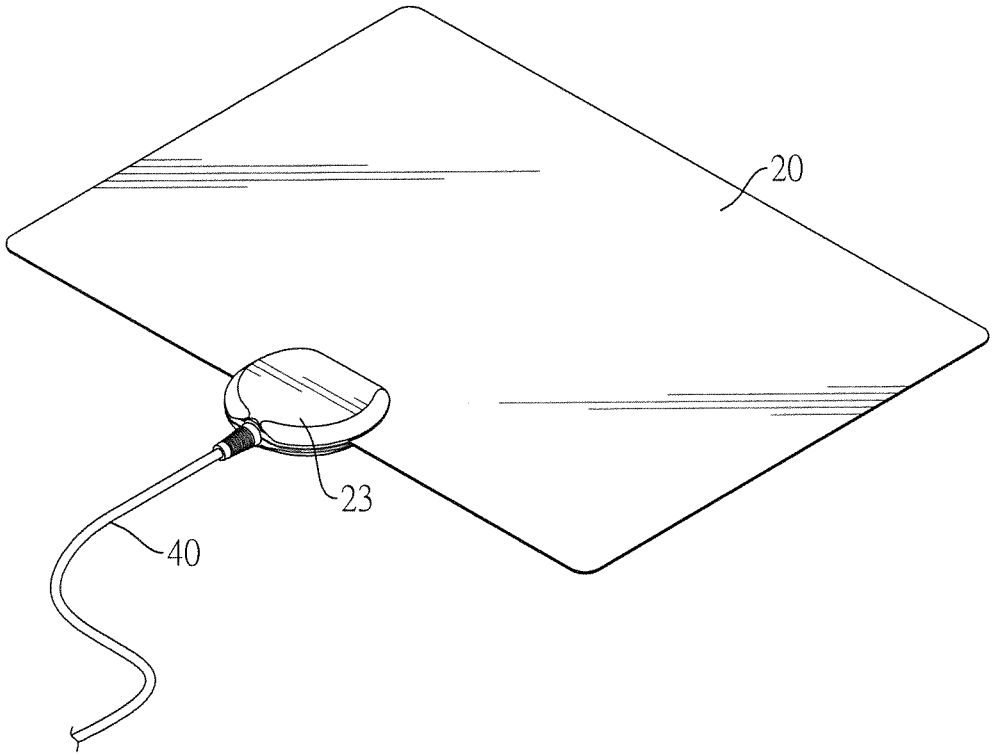
FIG. 1 is a perspective view of a thin flat panel style digital TV antenna.
Figure 2:
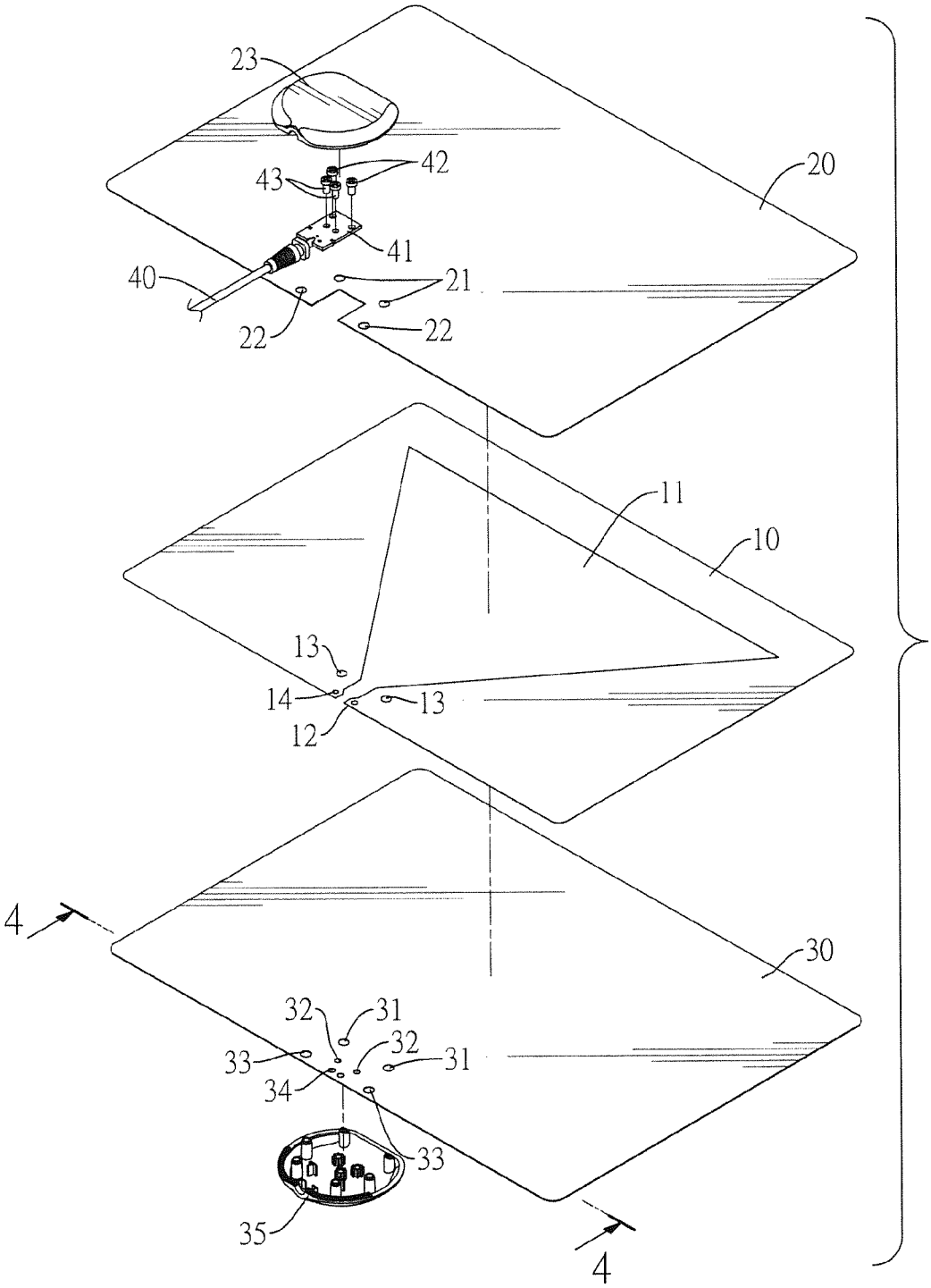
FIG. 2 is an exploded perspective view of the digital TV antenna in FIG. 1.
Figure 3:
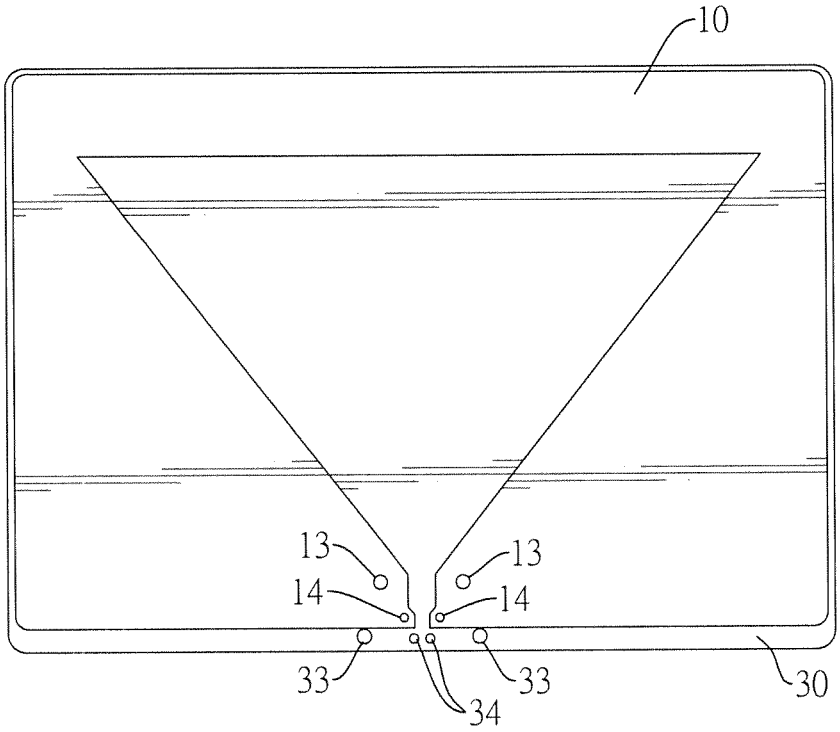
FIG. 3 is a top view of a radiation layer and a rear insulation layer of the digital TV antenna in FIG. 1.
Figure 4:
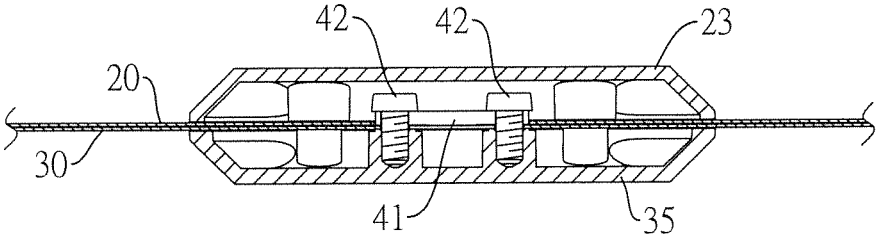
FIG. 4 is a side view in partial section of the digital TV antenna in FIG. 1.

With reference to FIGS. 1 to 4, a thin flat panel style digital TV antenna in accordance with the present invention has a radiation layer 10, a front insulation layer 20, a rear insulation layer 30 and a connection cable 40.

The radiation layer 10 is sheet-like and has a front surface and a rear surface opposite to each other, and multiple edges. In the present embodiment, the radiation layer 10 is rectangular and electrically conductive, and has four edges, a hollow area 11, an opening, two bulged portions 12 and multiple connection holes. The hollow area 11 is formed through the radiation layer 10, takes the form of an isosceles triangle, and has a vertex angle. The opening is formed in one of the edges of the radiation layer 10 adjacent to the vertex angle to communicate with the vertex angle. The two bulged portions 12 are oppositely formed on and protrude from two inner walls of the opening, and adjoin the edge of the radiation layer 10 that corresponds to the opening. The multiple connection holes include two electrical connection holes 14 and two third inner assembly holes 13. The two electrical connection holes 14 are respectively formed through the two bulged portions 12 for transmitting TV signals received by the radiation layer 10. The two third inner assembly holes 13 are formed through the radiation layer 10 and are more distal to the edge of the radiation layer 10 that corresponds to the opening than the electrical connection holes 14 for assembling the front insulation layer 20 and the rear insulation layer 30.

The front insulation layer 20 is mounted on the front surface of the radiation layer 10 to overlap, protect and electrically insulate the front surface of the radiation layer 10, is rectangular, sheet-like and insulating, and has four edges, an indentation, two first inner assembly holes 21 and two first outer assembly holes 22. The indentation is formed in one of the edges of the front insulation layer 20 to correspond to the opening and the bulged portions 12 of the radiation layer 10 with the two bulged portions 12 exposed when the front insulation layer 20 is overlapped on the radiation layer 10. The two first inner assembly holes 21 and the two first outer assembly holes 22 are formed through the front insulation layer 20 and are adjacent to the indentation. The two first inner assembly holes 21 of the front insulation layer 20 respectively communicate with the two third inner assembly holes 13 of the radiation layer 10. The two first outer assembly holes 22 are adjacent to the edge of the front insulation layer 20 that corresponds to the indentation, and have no contact with the radiation layer 10. In the present embodiment, the front insulation layer 20 further has a front half case 23 mounted on an outer surface of the front insulation layer 20 to fully cover the indentation, the two first inner assembly holes 21, and the two first outer assembly holes 22.

The rear insulation layer 30 is mounted on the rear surface of the radiation layer 10 to overlap, protect and electrically insulate the rear surface of the radiation layer 10, is rectangular, sheet-like and insulating, and has four edges, two second inner assembly holes 31, two bulged portion connection holes 32, two second outer assembly holes 33 and two cable fixing holes 34. In the present embodiment, the four edges of the rear insulation layer 30 are respectively aligned with the four edges of the front insulation layer 20. The two second inner assembly holes 31 communicate with the respective third inner assembly holes 13 of the radiation layer 10 and the respective first inner assembly holes 21 of the front insulation layer 20. The two bulged portion connection holes 32 communicate with the respective electrical connection holes 14 of the radiation layer 10. The two second outer assembly holes 33 communicate with the respective first outer assembly holes 22 of the front insulation layer 20. The two cable fixing holes 34 correspond to the opening of the radiation layer 10, have no contact with the radiation layer 10, also correspond to the indentation of the front insulation layer 20, and are not blocked by the front insulation layer 20. In the present embodiment, the rear insulation layer 30 further has a rear half case 35 mounted on an outer surface of the rear insulation layer 30 to fully cover the two second inner assembly holes 31, the two bulged portion connection holes 32, the two second outer assembly holes 33, and the two cable fixing holes 34. The rear half case 35 and the front half case 23 are assembled together.

The connection cable 40 is connected with the radiation layer 10, and has multiple connection terminals. In the present embodiment, the connection cable 40 further has a circuit board 41 mounted on one end of the connection cable 40. The multiple connection terminals include two bulged portion connection bolts 42 and two cable assembly bolts 43. The two bulged portion connection bolts 42 are sequentially mounted through the circuit board 41, the respective electrical connection holes 14 of the radiation layer 10, and the respective bulged portion connection holes 32 to electrically connect the circuit board 41 to the two bulged portions 12 of the radiation layer 10 and to fasten the two bulged portions 12 of the radiation layer 10 on the rear insulation layer 30. The two cable assembly bolts 43 are sequentially mounted through the circuit board 41 and the respective cable fixing holes 34 of the rear insulation layer 30 to fasten the circuit board 41 of the connection cable 40 on the rear insulation layer 30.

The digital TV antenna may further include four insulation assembly bolts to connect the front insulation layer 20 and the rear insulation layer 30 for the radiation layer 10 to be sandwiched between the front insulation layer 20 and the rear insulation layer 30. Two of the four insulation assembly bolts are sequentially mounted through the respective first inner assembly holes 21 of the front insulation layer 20, the respective third inner assembly holes 13 of the radiation layer 10, and the respective second inner assembly holes 31 of the rear insulation layer 30. The other two of the four insulation assembly bolts are sequentially mounted through the respective first outer assembly holes 22 of the front insulation layer 20 and the respective second outer assembly holes 33 of the rear insulation layer 30.

Figure 5:
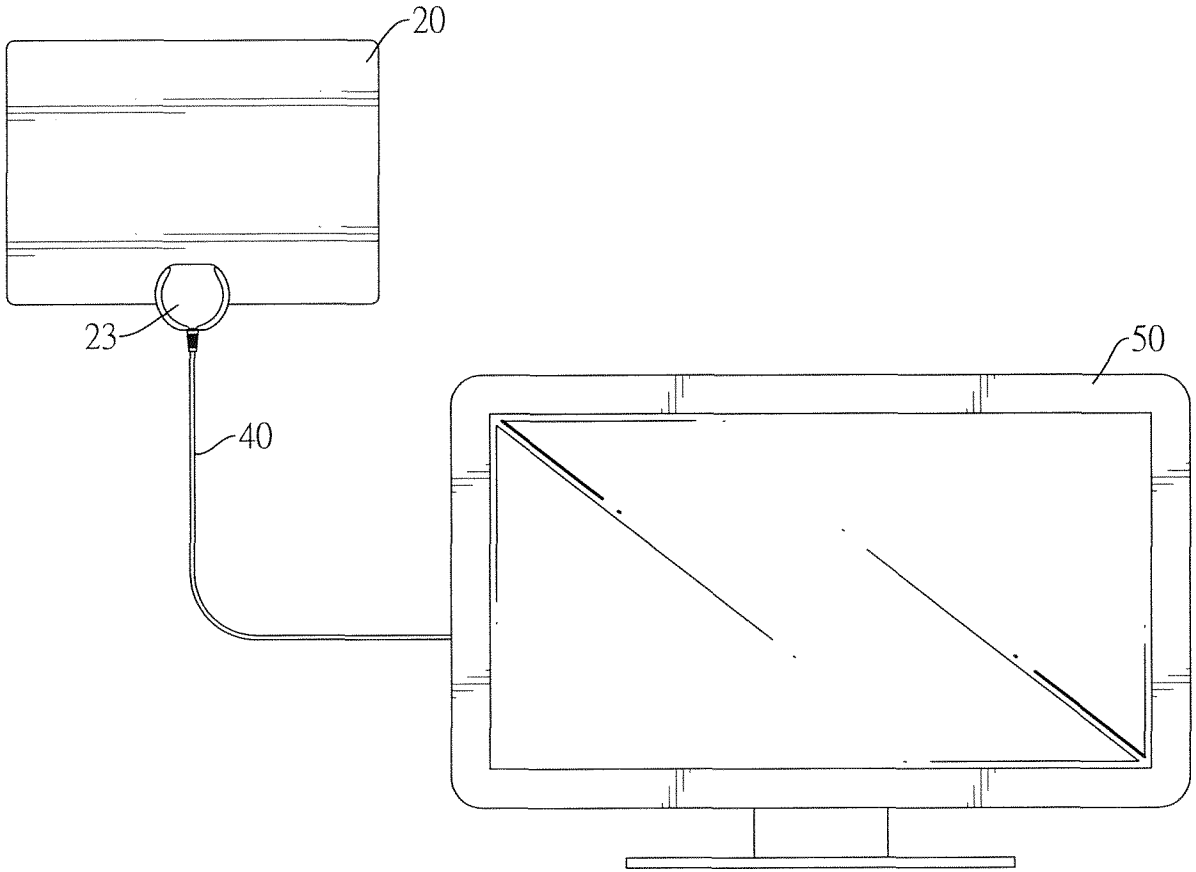
FIG. 5 is an operational schematic view of the digital TV antenna in FIG. 1 in connection with a digital TV.
Figure 6:
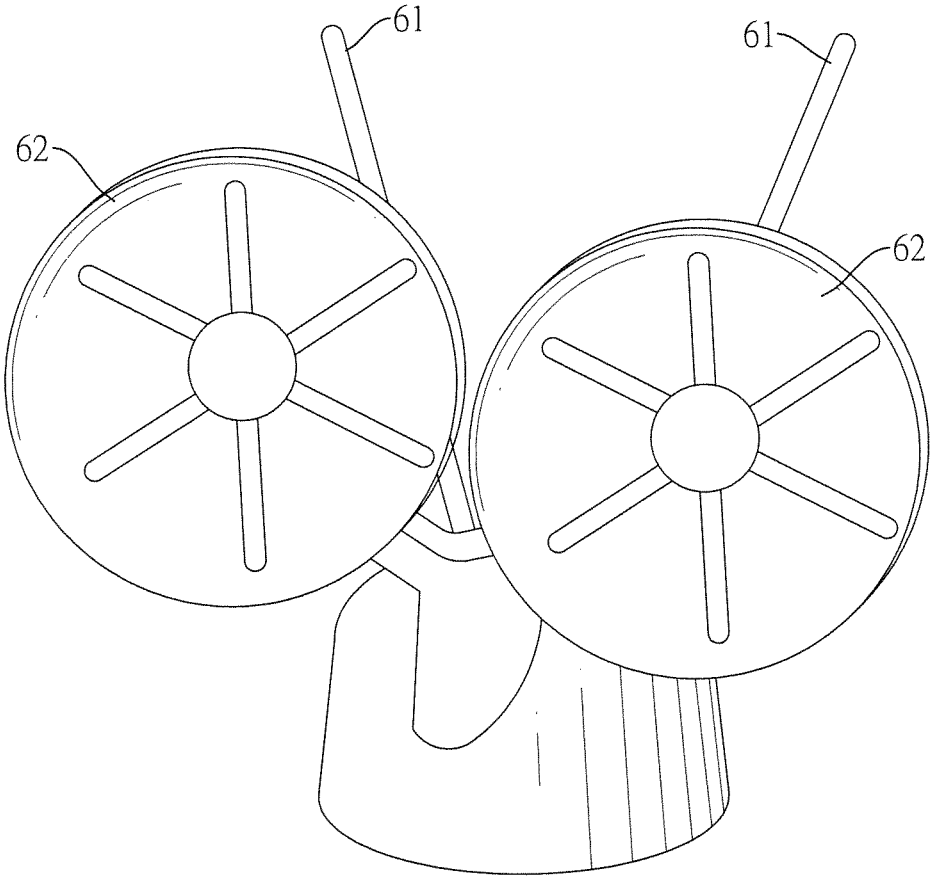
FIG.6 PRIOR ART
FIG. 6 is a schematic view of a conventional analog TV antenna.

With reference to FIG. 5, the front insulation layer 20 or the rear insulation layer 30 of the digital TV antenna is mounted on a wall with the connection cable 40 connected to an antenna in port of a digital TV 50. When the digital TV 50 is turned on, digital TV signals received by the radiation layer 10 are transmitted to the digital TV 50 through the connection cable 40, such that the digital TV 50 can analyze the received digital TV signals and display corresponding image frames on the screen of the digital TV 50.

In sum, the thin flat panel style digital TV antenna in accordance with the present invention employs the sheet-like radiation layer 10 to receive broadcast digital TV signals, and therefore has thin-profile and lightweight advantages to facilitate mounting, operation, cleanup, maintenance and storage of the digital TV antenna without occupying extra space. The assembly using the connection holes and the connection terminals for electrical connection also rules out the conventional soldering process to further ensure simplicity and cost-effectiveness of the present invention in production.

Even though numerous characteristics and advantages of the present invention have been set forth in the foregoing description, together with details of the structure and function of the invention, the disclosure is illustrative only. Changes may be made in detail, especially in matters of shape, size, and arrangement of parts within the principles of the invention to the full extent indicated by the broad general meaning of the terms in which the appended claims are expressed.

What is claimed is:

1. A thin flat panel style digital television antenna, comprising:

a radiation layer being sheet-like and having:

a front surface and a rear surface opposite to each other; multiple edges;

a hollow area formed through the radiation layer, taking the form of an isosceles triangle, and having a vertex angle;

an opening formed in one of the edges of the radiation layer adjacent to the vertex angle of the hollow area to communicate with the vertex angle;

two bulged portions oppositely formed on and protruding from two inner walls of the opening and adjoining the edge of the radiation layer that corresponds to the opening; and multiple connection holes formed through the radiation layer and being adjacent to the opening;

a front insulation layer mounted on and overlapping the front surface of the radiation layer, being rectangular, sheet-like and insulating, and having:

four edges;

an indentation formed in one of the edges of the front insulation layer to correspond to the opening and the bulged portions of the radiation layer with the two bulged portions exposed when the front insulation layer is overlapped on the radiation layer;

two first inner assembly holes formed through the front insulation layer, being adjacent to the indentation, and respectively communicating with the two third inner assembly holes of the radiation layer; and two first outer assembly holes formed through the front insulation layer, being adjacent to the edge of the front insulation layer that corresponds to the indentation, and being contactless with the radiation layer;

a rear insulation layer mounted on and overlapping the rear surface of the radiation layer; and a connection cable connected with the radiation layer and having multiple connection terminals in connection with the respective connection holes of the radiation layer;

wherein the multiple connection holes of the radiation layer has:

two electrical connection holes respectively formed through the two bulged portions of the radiation layer; and two third inner assembly holes formed through the radiation layer and being more distal to the edge of the radiation layer that corresponds to the opening of the radiation layer than the electrical connection holes for assembling the front insulation layer and the rear insulation layer.

2. The digital television antenna as claimed in claim 1, wherein the front insulation layer further has a front half case mounted on an outer surface of the front insulation layer to fully cover the indentation, the two first inner assembly holes, and the two first outer assembly holes.

3. The digital television antenna as claimed in claim 2, wherein the rear insulation layer is rectangular, sheet-like and insulating, and has:

four edges respectively aligned with the four edges of the front insulation layer;

two second inner assembly holes communicating with the respective third inner assembly holes of the radiation layer and the respective first inner assembly holes of the front insulation layer;

two bulged portion connection holes communicating with the respective electrical connection holes of the radiation layer;

two second outer assembly holes communicating with the respective first outer assembly holes of the front insulation layer; and two cable fixing holes corresponding to the opening of the radiation layer and the indentation of the front insulation layer, being contactless with the radiation layer and unblocked by the front insulation layer.

4. The digital television antenna as claimed in claim 3, wherein the rear insulation layer further has a rear half case mounted on an outer surface of the rear insulation layer to fully cover the two second inner assembly holes, the two bulged portion connection holes, the two second outer assembly holes, and the two cable fixing holes, and the rear half case and the front half case are assembled together.

5. The digital television antenna as claimed in claim 4, wherein the connection cable further has a circuit board mounted on one end of the connection cable, and the multiple connection terminals include two bulged portion connection bolts and two cable assembly bolts.

6. The digital television antenna as claimed in claim 5, wherein the two bulged portion connection bolts are sequentially mounted through the circuit board, the respective electrical connection holes of the radiation layer, and the respective bulged portion connection holes to electrically connect the circuit board to the two bulged portions of the radiation layer and to fasten the two bulged portions of the radiation layer on the rear insulation layer, and the two cable assembly bolts are sequentially mounted through the circuit board and the respective cable fixing holes of the rear insulation layer to fasten the circuit board of the connection cable on the rear insulation layer.

* * * * *